United States Patent [19]

Warren

[11] Patent Number: 4,589,229

[45] Date of Patent: May 20, 1986

[54] ADJUSTABLE DOOR JAMB ASSEMBLY

[76] Inventor: Lawrence L. Warren, 6586 Fruitgift Pl., Columbia, Md. 21045

[21] Appl. No.: 223,145

[22] Filed: Jan. 7, 1981

[51] Int. Cl.[4] ..... E06B 1/04

[52] U.S. Cl. ..... 49/505; 49/382; 52/212; 52/217

[58] Field of Search ..... 49/505, 504, 382, 380; 52/212, 217, 211; 403/364

[56] References Cited

U.S. PATENT DOCUMENTS

| | | | |
|---|---|---|---|
| 2,718,291 | 9/1955 | Goldberg | 49/504 |
| 3,040,390 | 6/1962 | Carlton | 52/211 |
| 3,494,076 | 2/1970 | Todd | 49/505 |
| 3,545,135 | 12/1970 | Lieber | 49/505 |
| 3,757,473 | 9/1973 | Mundy | 49/505 X |
| 3,769,773 | 11/1973 | Mochizuki | 49/504 X |
| 3,800,488 | 4/1974 | Swanson | 49/505 X |
| 3,886,688 | 6/1975 | Ragland | 49/504 |
| 3,889,423 | 6/1975 | Begin | 49/504 |

FOREIGN PATENT DOCUMENTS

| | | | |
|---|---|---|---|
| 488707 | 11/1918 | France | 403/364 |

*Primary Examiner*—Philip C. Kannan
*Attorney, Agent, or Firm*—Sachs & Sachs

[57] ABSTRACT

A door jamb assembly for varied installations in a conventional rough cut door opening disposed in a wall, the assembly including first, second, and third elongated members for mounting on the sides and top of the rough cut door opening to form a pair of door jambs and a header. Two of the elongated members are configured so that they will mate on one end thereof to the first elongated member and on the other end thereof to a portion of the other elongated member between the ends thereof, these two elongated members being essentially mirror images of each other. As a result, a door jamb assembly is provided which can be installed in various width door openings to provide jambs for doors which can be hung with left or right hinges and which open in or out. Additionally, the width of the jambs and header is variable to accommodate walls of different thicknesses.

14 Claims, 13 Drawing Figures

ADJUSTABLE DOOR JAMB ASSEMBLY

BACKGROUND AND/OR ENVIRONMENT OF THE INVENTION

1. Field of the Invention

The present invention relates to door jambs, and more particularly, to a door jamb assembly for varied installations in a conventional rough cut door opening disposed in a wall.

2. Description of the Contemporary and/or Prior Art

The construction industry has benefited greatly from standardization of construction materials. One area in which this standardization is prevalent is that of door jambs and doors. Most doors have been standardized to fit a door opening of six feet eight inches high and widths from one foot to three feet wide, these widths normally being one foot, one foot six inches, two feet, two feet four inches, two feet six inches, two feet eight inches, and three feet. Walls are more or less standardized at three and one half inch and four and one half inch thicknesses. As is even well known to the casual observer, most doors can be hung so they are left handed or right handed, i.e., they have their hinges on the left hand side or on the right hand side of the door jamb and open away from the viewer or can be hung as left hand reverse or right hand reverse where the hinges are on the left side or the right side of the door, respectively, with the door opening toward the viewer.

All of these variations represent fifty-six different combinations despite standardization. Certainly, many differently dimensioned door jamb assemblies or sets must be provided to accommodate all these variations. These door jamb sets or assemblies customarily are mounted to a rough cut door opening in a wall and then the door is mounted to the door jamb set, or so-called "pre-hung" doors are employed where the door jamb set is fitted to a door and the door and door jamb are simultaneously installed in the door opening.

Several door jamb sets are known which can accommodate different thickness walls. Typical of these apparatuses are those shown in U.S. Pat. Nos.: 2,736,930 to Longley; 3,040,390 to Carlton; 3,545,135 to Lieber; 3,757,473 to Mundy; 3,800,488 to Swanson; 3,884,003 to Herr et al; 3,981,103 to McAllister; 4,126,975 to Williams; and 4,128,977 to Schubeis. Differently configured adjustable and/or prefabricated door or window jambs are shown in U.S. Pat. Nos.: 2,595,506 to Backman; 2,872,711 to Killebrew; 3,239,978 to Parker; 3,553,891 to Casebolt et al; 3,583,114 to Belfor; and 3,685,226 to Richter. A casing for a shower stall is shown in U.S. Pat. No. 3,111,208 to Grossman None of the aforenoted references show or suggest a door jamb assembly having conventional door stop for mounting a conventional door wherein different thickness walls, different width door openings, and right and left hand as well as left hand reverse and right hand reverse door swings can be accommodated with only three elongated members as taught by the present invention Thusly, the present invention overcomes the problems and shortcomings of the prior art and provides a door jamb assembly which can be quickly and easily employed in all of the aforementioned fifty-six applications.

SUMMARY OF THE INVENTION

Therefore, a primary object of the present invention is to provide a door jamb assembly for varied installations in conventional rough cut door openings disposed in a wall.

A further object of the present invention is to provide a door jamb assembly which can accommodate different thickness walls.

A still further object of the present invention is to provide a door jamb assembly for installation in different width door openings for mounting the correspondingly differently widthed doors.

Another still further object of the present invention is to provide a door jamb assembly which can be utilized for hanging left hand, right hand, left hand reverse, and right hand reverse doors.

Still another further object of the present invention is to provide a door jamb assembly which can accomplish all of the aforementioned objects and which comprises only three elongated assemblies.

Still another additional object of the present invention is to provide a door jamb assembly which can be premortised for door hinges and door striker plates.

An additional object of the present invention is to provide a door jamb assembly which is modified to fit different width door openings with a single relatively imprecise cut.

Another still additional object of the present invention is to provide a door jamb assembly which has the appearance of conventional door jambs and a conventional header when installed.

Still another further object of the present invention is to provide a door jamb assembly which can be easily and readily milled from wood using known techniques.

Another further additional object of the present invention is to provide a door jamb assembly which is suited for construction of materials other than wood such as plastic and metal.

An additional further object of the present invention is to provide a door jamb assembly which can be employed to create a "pre-hung" door when used in conjunction with a door.

An additional still further object of the present invention is to provide a door jamb assembly which is simple in design, relatively inexpensive to manufacture, rugged in construction, easy to install, and durable.

These objects, as well as further objects and advantages of the present invention, will become readily apparent after reading the ensuing description of a nonlimiting illustrative embodiment and examining the accompanying drawing.

A door jamb assembly for varied installations in a conventional rough cut door opening disposed in a wall, according to the principles of the present invention, comprises in combination: A first elongated member for mounting on one side of the rough cut door opening, the first member including a facing portion and a door stop portion positioned at an outer surface of the first member when mounted, the first member having a first end and a second end; and second and third elongated members for mounting on the other side and top of the door opening, the second and third elongated members each having first and second ends and each comprising a facing portion and a door stop portion positioned on an outer surface thereof when mounted, the second member for mounting on the top of the door opening when the third member is mounted on the other side of the door opening, the first end of the second member for mating with the first end of the first member, the first end of the third member for mating with a portion of the second member anywhere intermediate the first and second ends thereof, the first, second, and third elongated members being adjustable in width. In another embodiment, aside from the second member being mountable on the top of the door opening with the third member mounted on the other side of the door opening, the third member is mountable on the top of the door opening when the second member is mounted on the other side of the door opening, the second end of the third member therefore mating with the second end of the first member, the second end of the second member therefore for mating with a portion of the third member anywhere intermediate the first and second ends thereof.

Further, variable width jamb stock, in accordance with the principles of the present invention, comprises in combination an elongated base section providing a capturing portion; and an elongated movable section providing a pair of parallel longitudinal tongues of the different widths joined by a longitudinal bight portion, either of the tongues being capturable within the capturing portion of the base section, capturing of the wider of the tongues providing a facing portion of a width wider than the facing portion provided when the narrower of the tongues is captured by the capturing portion.

BRIEF DESCRIPTION OF THE DRAWING

In order that the present invention may be more fully understood, it will now be described, by way of example, with reference to the accompanying drawing in which.

DESCRIPTION OF THE PREFERRED EMBODIMENT

Figure 1:
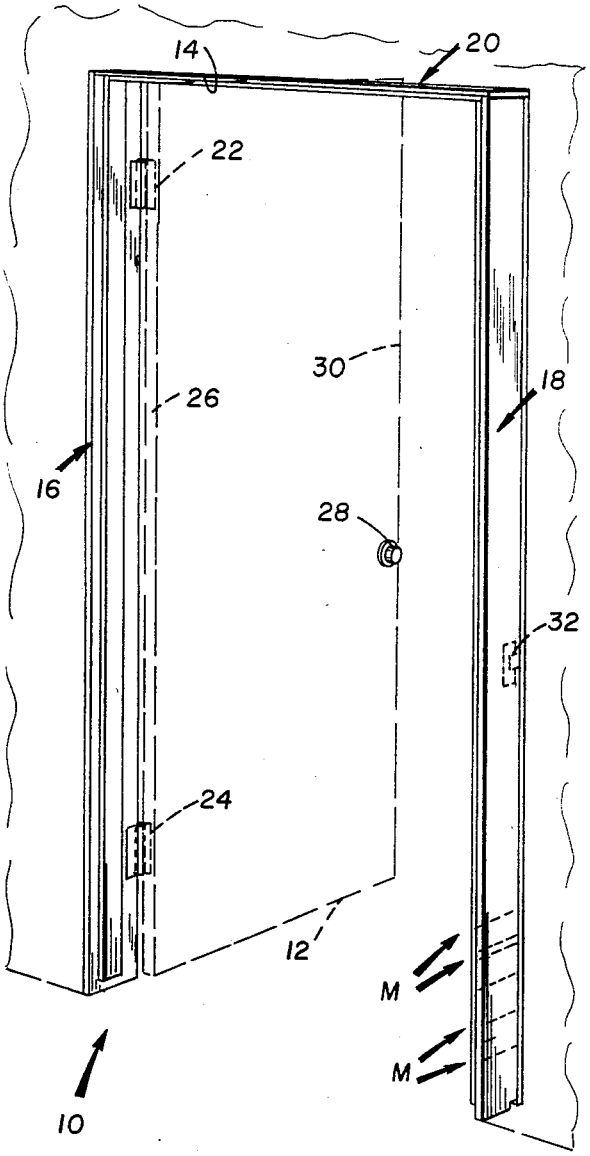
FIG. 1 is a pictorial representation of a door jamb assembly incorporating the principles of the present invention mounted in a rough cut door opening disposed in a wall and mounting a conventional door.

Referring now to the figures, and more particularly to FIG. 1 thereof, there is illustrated therein a door jamb assembly 10 which mounts to a door 12. The door jamb assembly 10 is illustrated installed in a conventional rough cut door opening 14, illustrated by phantom lines. The door jamb assembly 10 includes a first elongated member 16, a second elongated member 18, and a third elongated member 20. The first, second, and third elongated members 16, 18, and 20 are assembled as illustrated and as hereinafter described to frame the interior of the rough cut door opening 14 and to mount the left hand door 12. First and second elongated members 16 and 18 serve as door jambs and third elongated member 20 serves as a header.

The door 12 is affixed tc the first elongated member 16 by a pair of hinges 22 and 24, with one leaf of each of the hinges being fixedly secured in a conventional manner to the hinge stile 26 of the door 12, the other leaf of each of the hinges 22 and 24 being fixedly secured to the elongated member 16. The leaves of the hinges 22 and 24 can be mounted into mortised recesses in the stile 26 and the first elongated member 16 or can be surface mounted as desired.

The door 12 is provided with a conventional lock set 28 having a latch, not illustrated, which extends through the lock stile 30 of the door 12. The latch of the lock set 28 is engaged, when the door 12 is closed, by a strike 32 mounted on the second elongated member 18. Although the door jamb assembly is illustrated in FIG. 1 mounting a left hand door, the first, second, and third elongated members 16, 18, and 20 thereof can be employed to mount right hand, left hand reverse, and right hand reverse doors by inversion and/or reversal or interchanging of the positions of the first, second, and third elongated members 16, 18, and 20 as hereinafter described.

Figure 2:
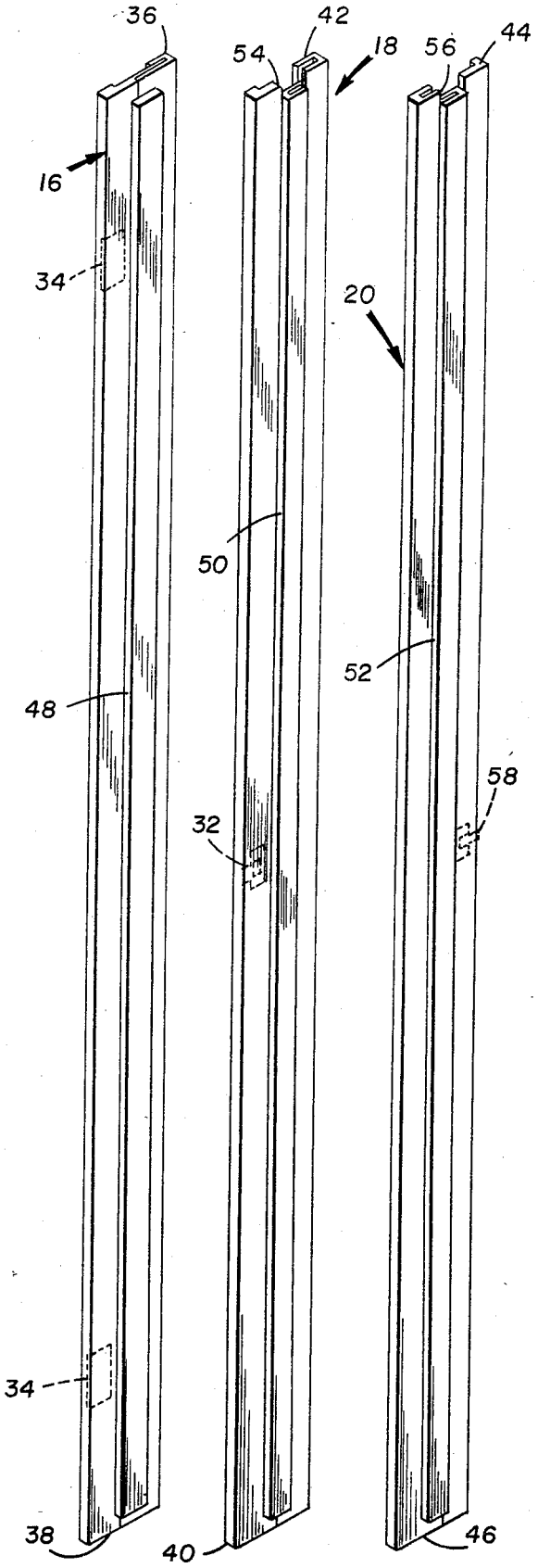
FIG. 2 is a pictorial representation in perspective of the first, second, and third elongated members of the present invention.

Referring to FIG. 2, the first, second, and third elongated members 16, 18, and 20 are each illustrated. Third elongated member 20 is shown in its full length rather than its shorter, cut length as illustrated in FIG. 1 when a portion thereof is used to form a header of the door jamb assembly 10.

In every installation, the first elongated member 16 is used to form one of the door jambs and as shown in FIG. 2, it may include a pair of hinge mortises 34. The first elongated member 16, as illustrated in FIG. 2, is inverted, top to bottom, relative to the illustration of the same element in FIG. 1. By inverting the first elongated member 16, the hinge mortises 34 are reoriented to permit hanging of different handed doors.

First elongated member 16 has a first end 36 and a second end 38, second elongated member 18 has a first end 40 and a second end 42, and third elongated member 20 has a first end 44 and a second end 46. The first end 36 of the first elongated member 16 is configured so that it will mate with the first end 40 of the second elongated member 18. Similarly, the second end 38 of the first elongated member 16 is configured to mate with the second end 46 of the third elongated member 20. With the first elongated member 16 serving as one door jamb, door jamb assembly 10 can be assembled with the second elongated member 18 serving as a header, when the end 40 thereof mating with the end 36 of the first elongated member 16 or the assembly 10 can be assembled with the third elongated member 20 serving as a header, the second end 46 thereof mating with the second end 38 of the first elongated member 16.

The first elongated member 16 includes a door stop 48, the second elongated member 18 includes a door stop 50, and the third elongated member 20 includes a door stop 52. The door stops 48, 50, and 52 are conventional in appearance and cooperate with the door hung from the door jamb assembly 10 in a conventional manner for conventional door stop purposes. To permit mating of the second and third elongated members 18 and 20, the second end 42 of the second elongated member 18 has a notch 54 disposed therein and the first end 44 of the third elongated member 20 has a notch 56 disposed therein. The notches 54 and 56 are dimensioned so that they accommodated therein, respectively, door stops 52 and 50 when the second and third elongated members 18 and 20 are mated as hereinafter described and illustrated.

As second elongated member 18 is provided with a lock strike 32, so is third elongated member 20 provided with a lock strike 58. Second and third elongated members 18 and 20 are essentially the exact reverse or mirror image of each other and are configured suchly so that different handed doors, as previously described, can be accommodated.

As is well known in the art, standard construction procedures present walls which are 3½ of 4½ inches thick. Standard doors are six feet eight inches in height and are constructed in widths of one foot, one foot six inches, two feet, two feet six inches, two feet eight inches, and three feet. All these various dimensions can be accommodated with the first, second, and third elongated members 16, 18, and 20. The different thickness walls are accommodated by the variable width feature of the first, second, and third elongated members 16, 18, and 20.

Figure 3:
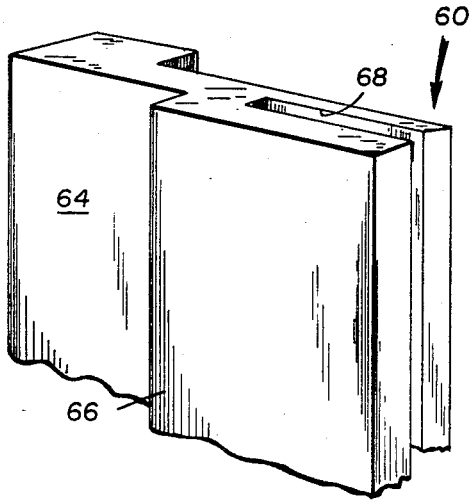
FIGS. 3 and 4, respectively, show fragmentary views in perspective of the base section stock and movable section stock which are used to form the first, second, and third elongated members.
Figure 4:
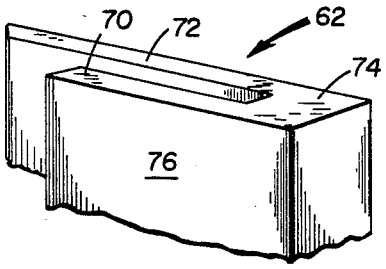

This variable width is effected by construction of each of the members 16 and 18 and 20 from a novel standardized door jamb stock illustrated in FIGS. 3 and 4. This standardized door jamb stock includes an elongated base section 60 illustrated in FIG. 3 and an elongated movable section 62 illustrated in FIG. 4. The base section 60 provides a facing portion 64, a door stop portion 66, and a longitudinal groove 68 directly adjacent thereto. The movable section 62 has a substantially "J" shaped cross section and provides a pair of tongues 70 and 72 joined by an elongated bight portion 74. The tongues 70 and 72 are substantially parallel and are of different widths, tongue 72 having a greater width than tongue 70. The tongues 70 and 72 are dimensioned to be captured and slidably retained in groove 68. Since the tongues 70 and 72 are of different widths as illustrated, insertion of tongue 70 in groove 68 will provide a door jamb stock of one width with inversion of the movable section 62 from the position illustrated in FIG. 4 and insertion of the tongue 72 in groove 68 providing a jamb stock of a larger width.

When tongue 70 is inserted in groove 68, the facing portion 76 thereof lies in the same plane as the facing portion 64 of the base section 60, the surfaces 64 and 76 therefore being substantially coplanar and coextensive. When tongue 72 is inserted in groove 68, the outer surface thereof, not visible in FIG. 4, serves as a facing portion and also has the same relationship with surface 64 as surface 76. By dimensioning the tongues 70 and 72 and the bight portion 74 of the movable section 62 properly, different width walls can be accommodated. Although it is preferred that tongues 70 and 72 be seated all the way within groove 68, minor wall width variations can be accommodated by the telescoping of sections 60 and 62 relative to each other. The basic configuration of base section 60 and movable section 62 will find application in other door jamb assemblies aside from the further interlocking and mating teachings of the present invention and these elements can be readily milled using known techniques from wood. Additionally, base section 60 and movable section 62 can be cast or otherwise formed from plastic or made out of metal using known manufacturing techniques.

Figure 5:
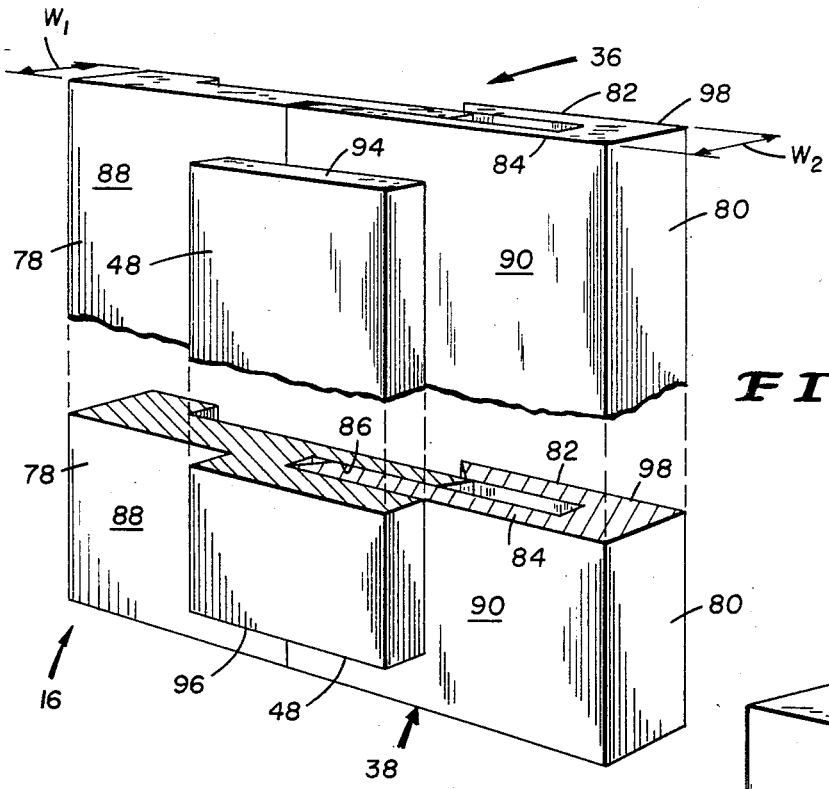
FIG. 5 is a fragmentary and cross-sectional view in perspective of the first elongated member of the present invention.

With reference to FIG. 5, the upper and lower ends of the first elongated member 16 are illustrated with first elongated member 16 being assembled in a wide configuration. First elongated member 16 has been manufactured from door jamb stock identical to base section 60 and movable section 62 of FIGS. 3 and 4. First elongated member 16 includes a base section 78 and a movable section 80 having tongues 82 and 84. Tongue 84 is inserted and captured by groove 86 disposed in base section 78. Facing surfaces 88 and 90, respectively, of base section 78 and movable section 80 are therefore substantially coplanar as illustrated and door stop 48, which is integrally formed with the base section 78, is disposed substantially at the middle of the first elongated member 16. Aside from cutting first elongated member 16 to the proper height or length, the only other milling or cutting which is necessary to structure member 16 is the recessing of the upper end 94 and lower end 96 of the door stop 48, respectively, from the upper end 36 and lower end 38 of the first elongated member 16. These recesses are the same dimensions as the width of the base section 78 taken at $W_1$ or the width of movable section 80 taken at $W_2$, both these widths being identical, as illustrated in FIG. 5. If first elongated member 16 is assembled in a narrow configuration, facing surface 88 would be coplanar with facing surface 98 as a result of the insertion of tongue 82 in groove 86.

Figure 6:
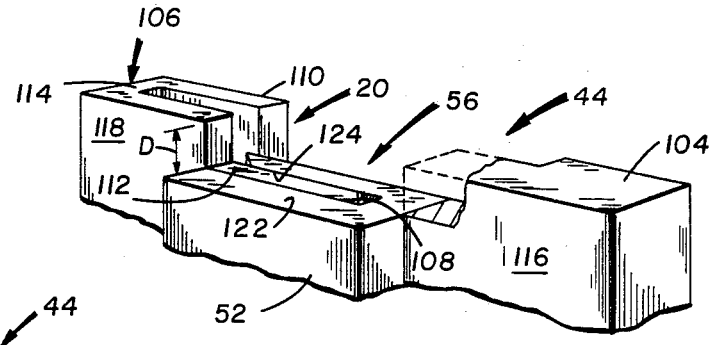
FIG. 6 is a fragmentary top view of the third elongated member of the present invention, partially broken away, assembled in a wide configuration.
Figure 7:
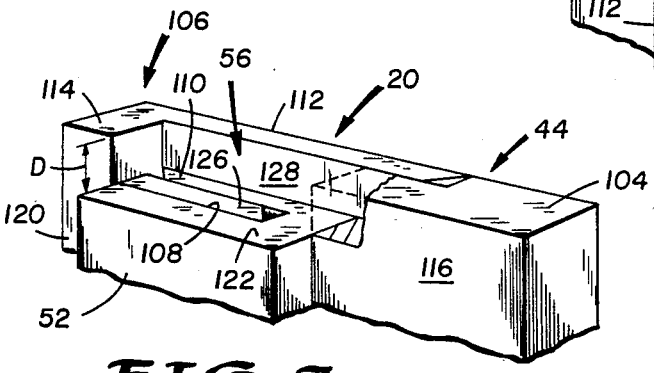
FIG. 7 is a fragmentary top view of the third elongated member of the present invention, partially broken away, assembled in a narrow configuration.

Referring to FIGS. 6 and 7, there is illustrated therein the first end 44 of the third elongated member 20. The third elongated member 20 comprises a base section 104, made from stock similar to base section 60 of FIG. 3 and a movable section 106, constructed of stock essentially the same as movable section 62 of FIG. 4. The base section 104 has a groove 108 longitudinally disposed therein. Movable section 106 includes tongues 110 and 112 joined by a bight portion 114. The smaller tongue 110 is illustrated inserted in the groove 108 in FIG. 7 and the wider tongue 112 is illustrated disposed in the groove 108 in FIG. 6. As should be obvious from the previous disclosure, this is accomplished by inversion of the movable section 106 relative to the base section 104. The facing surface 116 of the base section 104 is substantially coplanar with the facing surface 118 of the movable section 106 when assembled as illustrated in FIG. 6. Similarly, the facing surface 116 is substantially coplanar to the facing surface 120 of the movable section 106 when the base section 104 and the movable section 106 are assembled as illustrated in FIG. 7.

Notch 56 is provided in order to permit mating of the first end 44 of the third elongated member 20 with a portion of the second elongated member 18 disposed between the ends 40 and 42 thereof. The depth D of notch 56 is identical to the distance the door stop 50 extends above the facing surfaces of the second elongated member 18. The notch 56 is formed by a notch 122 cut into the base section 104 and either notch 124 or 126 cut, respectively, into the opposite ends of movable section 106. In FIG. 7, the notch 56 is bordered or bounded by a portion 128 of movable section 106, however, this does not interfere with the assembly of the present invention as will hereinafter be discussed in conjunction with FIG. 13.

Figure 8:
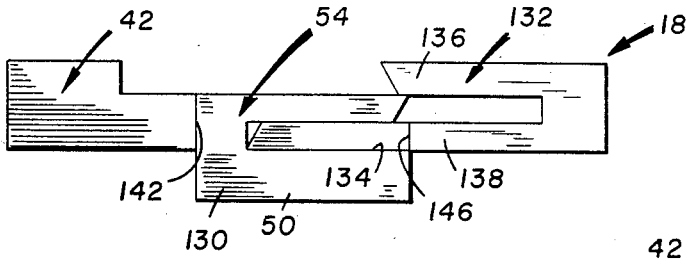
FIG. 8 is a top plan view of the second elongated member of the present invention assembled in a wide configuration.
Figure 9:
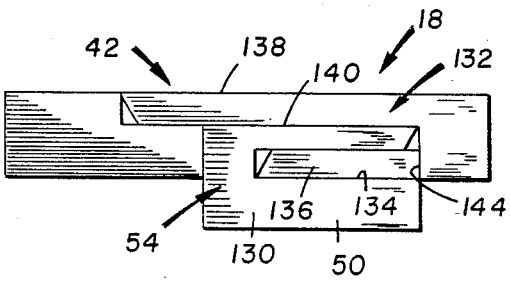
FIG. 9 is a top plan view of the second elongated member of the present invention assembled in a narrow configuration.
Figure 10:
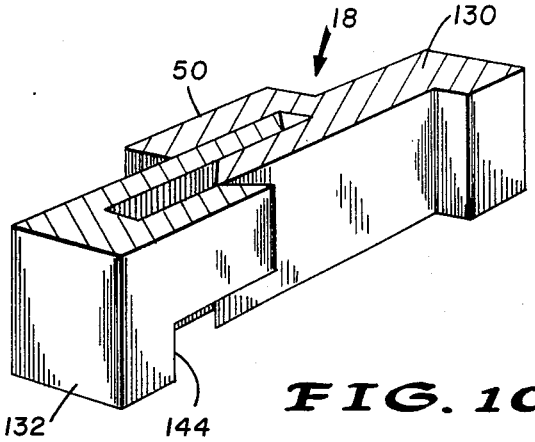
FIG. 10 is a rear cross-sectional view in perspective of the bottom of the third elongated member of the present invention assembled in a wide configuration.

The second end 42 of the second elongated member 18 is substantially the mirror image of the first end 44 of the third elongated member 20, the second end 42 of the second elongated member being illustrated in FIGS. 8 and 9. The second elongated member 18 comprises a base section 130 and a movable section 132. The base section 130 is constructed of stock essentially similar to that illustrated in FIG. 3 and the movable section 132 is constructed of stock essentially similar to that illustrated in FIG. 4. The base section 130 has a longitudinal groove 134 disposed therein. The groove 134 is dimensioned to capture and retain therein the tongues 136 and 138 of the base section 130. Either tongue 136 or 138 can be disposed within groove 134 to vary the width of the second elongated member 18 as the widths of the first elongated member 16 and the third elongated member 20 can also be varied.

The notch 54 disposed in the second end 42 of the second elongated member 18 is formed by notching of the base section 130 and movable section 132 in the same manner as the notch 56 is formed in the first end 44 of the third elongated member 20. When the base section 130 and the movable section 132 are assembled as illustrated in FIG. 9, the notch 54 is bounded by a portion 140 of the tongue 138. The notch 54 is formed by a notch 142 disposed in the base section 130 and either a notch 144 or 146 disposed in opposite ends of the movable section 132. The notches 144 and 146 are the reflection of the notches 126 and 124 shown in FIGS. 6 and 7.

Figure 11:
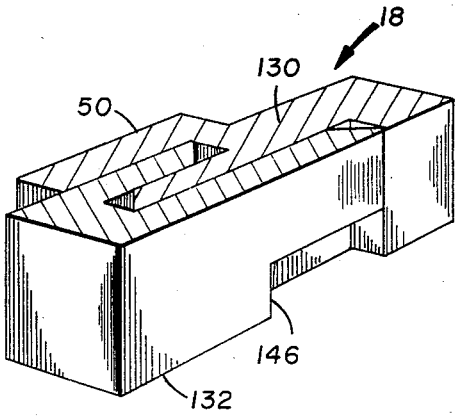
FIG. 11 is a rear cross-sectional view in perspective of the bottom of the third elongated member of the present invention assembled in a narrow configuration.

Of course, when movable section 132 is inverted relative to base section 130, the notch 144 or 146, not being employed, is disposed in a position where it is not used and is hidden. Viewing FIGS. 11 and 12 in conjunction with FIGS. 8 and 9, this should be apparent. Notch 146 is employed in FIG. 8 to form notch 54 when the second elongated member 18 is a wide configuration as shown in FIG. 8 and is hidden at the back thereof as shown in FIG. 11 when notch 144 is employed to form notch 54 as illustrated in FIG. 9. Similarly, when notch 146 is employed to form notch 54, notch 144 is disposed at the back of the second elongated member 18. As a result, the second elongated member 18 can be switched from a wide to a narrow configuration without any additional notching of the base section 130 and movable section 132 aside from the original forming or cutting of the notches 142, 144, and 146. Such is also the case with the third elongated member 20 and the notches 122, 124, and 126 thereof as illustrated in FIGS. 6 and 7.

Figure 12:
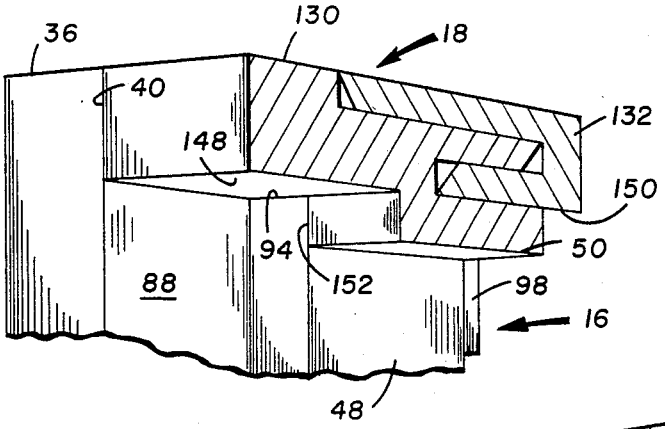
FIG. 12 is a fragmentary cross-sectional view in perspective of the mating, of the first and second elongated members in a narrow configuration.
Figure 13:
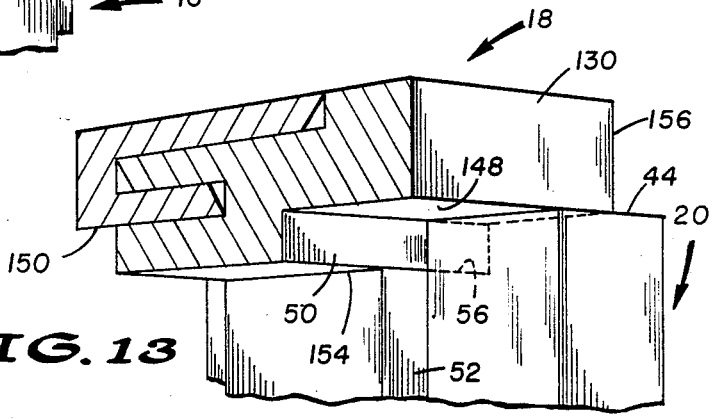
FIG. 13 is a fragmentary cross-sectional view in perspective of the mating of the second and third elongated members of the present invention.

The interfitting of first, second, and third elongated members 16, 18, and 20 in one possible configuration is shown in FIGS. 12 and 13. First, second, and third elongated members 16, 18, and 20 are shown in a narrow configuration although the interlocking of these members would be similar if assembled in a wide configuration. With reference to FIG. 12, the first end 40 of second elongated member 18 is mated to the portion of the first elongated member adjacent to the first end 36 thereof. The end 40 butts flushly against the facing surfaces 88 and 98 of the first elongated member 16. Simultaneously, the upper end 94 of the door stop 48 of the first elongated member 16 butts flushly against the facing surfaces 148 and 150 of the second elongated member 18. At the same time, the end 152 of the door stop 50 of the second elongated member 18 butts flushly against a portion of the door stop 48 of the first elongated member 16 adjacent to the end 94 thereof. As a result, the first and second elongated members 16 and 18 mate together substantially perpendicularly in a manner which gives the exact appearance of a customary door jamb and door stop installation.

Such is also the case insofar as appearance is concerned with the substantially perpendicular mating of the second elongated member 18 and the third elongated member 20 as illustrated in FIG. 13. Once the width of the rough cut door opening is determined, whichever of the second or third elongated members 18 and 20 is to be used as a header, is cut to the proper length. The balance of this cut piece is then discarded. Assuming that the second elongated member 18 as illustrated in FIG. 13 has been already cut, its engagement by the first end 44 of the third elongated member 20 is illustrated in FIG. 13. The door stop 50 of the second elongated member 18 is accommodated within the notch 56 that has been suitably dimensioned to receive the same. The upper end 154 of the door stop 52 therefore meets flushly against the outer surface of the door stop 50 and the first end 44 of the third elongated member 20 rests against the facing surfaces 148 and 150 of the second elongated member 116.

It should be apparent that the cut end 156 of the second elongated member 18 does not have to be cut evenly or with particular precision since it will not be visible after the customary moldings are placed on the installed door jamb assembly 10. If the first, second, and third elongated members 16, 18, and 20 are in a wide configuration as illustrated in the previous drawings, the length of the second or third elongated member 18 or 20, used as a header, can vary to the same extent as when the first, second, and third elongated members 16, 18, and 20 are assembled in a narrow configuration since in the narrow configuration, the door stop portion of the header must be no longer than to rest against either portion 128 of the third elongated member 20 or portion 140 of second elongated member 18 and in the wide configuration, the header must be no longer than to rest on the inside portions of the tongue 110 or 136 in line, respectively, with groove 56 or 54. In both cases, the cut end of the second and third elongated members 18 and 20 which forms the header is entirely hidden from view therefore permitting relatively unskilled personnel to effect comparitively inaccurate cuts without accrual of any detriment to the aesthetic appearance of the door jamb assembly 10.

A typical installation of the door jamb assembly 10 would be accomplished as follows: The thickness of the rough cut door opening in which the assembly 10 is to be installed would be determined and the base sections and movable sections of the first, second, and third elongated members 16, 18, and 20 would be engaged together accordingly. The first elongated member 16 would then be mounted at one side of the rough cut door opening. To fit a standard six feet eight inch opening, the first elongated member would be manufactured to a length of 81⅝ inches long. The first elongated member 16 would be installed in the rough cut door opening paying attention to the proper swing or hand of the door. Once the first elongated member 16 is fixed in position, if the first end 36 thereof is adjacent to the top portion of the door, it would be mated with the first end 40 of the second elongated member 18, the second elongated member 18 becoming a header. Alternately, if the second end 38 of the first elongated member 16 is disposed adjacent to the top of the door, it will be mated with the second end 46 of the third elongated member 20. The second and third elongated members 18 and 20 are both preferably marked, as illustrated by dashed lines M, on the back surface thereof from the ends 40 and 46 thereof for premeasured lengths of one foot, one foot six inches, two feet, two feet six inches, two feet eight inches, and three feet, with the total length of the second and third elongated members 18 and 20 preferably being 80 15/16 inches long. The second or third elongated member 18 or 20 which is selected to be the header is then cut to the appropriate length at the appropriate marking to form the correct length header. The header is then affixed into position to the top of the rough cut door opening as is the other of the second and third elongated members 18 and 20 which is to become the second door jamb. The first, second, and third elongated members 16, 18, and 20 are secured to the rough cut door opening in a conventional manner using shims and nails along with a level to check the proper position. Once this has been accomplished, hinges can be mounted to the first elongated member 16 and a door can be hung in the door opening. The door is finished by installing appropriate moldings on both sides of the wall surface with the lips thereof touching the edge of the first, second, and third elongated members 16, 18, and 20.

The door jamb assembly 10 is also suited for construction of "pre-hung" doors. These doors are of the type well known in the art wherein door jambs, headers, and moldings are prefitted to a door. By stocking a single size set of door jamb assemblies 10, a door manufacturer can make a pre-hung door out of virtually any size standard door. For such an installation, the first, second, and third elongated members, 16, 18, and 20 would be fitted around a door affixed together, and then would be banded or strapped in position for shipping. The lowermost edge of the door jambs could be secured together with the scrap portion of the header, normally discarded. Since the first, second, and third elongated members 16, 18, and 20 can be separated, molding can be preattached to the door jamb and the door jamb can be split in half with the base portions of the first, second, and third elongated members 16, 18, and 20 being separated from the movable sections thereof so that these segments can sandwich the wall, forming the rough cut door opening, therebetween in a conventional manner as is now accomplished by pre-hung doors.

It should be apparent to one skilled in the art that the door jamb assembly 10 can be prerouted for door hinges and a strike if desired or this can be accomplished upon installation. Additionally, although the hinges are shown mounted on first elongated member 16, they can be mounted on second or third elongated members 18 or 20 whichever is used as a jamb (rather than a header) in a particular installation.

It will be understood that various changes in the details, materials, and arrangements of the parts and operational and assembly conditions which have been herein described and illustrated in order to explain the nature of the invention may be made by those skilled in the art within the principles and scope of the present invention.

Having thus set forth the nature of the invention, what is claimed is:

1. A door jamb assembly for varied installations in a rough cut door opening in a wall comprising in combination:

a first elongated member for mounting on one side of said rough cut door opening, said first member including a facing portion and a door stop portion positioned at an outer surface of said first member when mounted, said first member having a first end and a second end; and second and third elongated members for mounting on the other side and top of said door opening, said second and third elongated members each having first and second ends and comprising a facing portion and a door stop portion positioned on an outer surface thereof when mounted, said facing portions of said first, second, and third elongated members being variable in width for mounting in door openings cut in walls of different thicknesses, said first, second, and third elongated members each comprising an elongated base section and an elongated movable section, each of said elongated movable sections being movable in relation to the associated said base section to vary the width of said first, second, and third elongated members, a portion of each of said movable sections being captured and slidably retained by a capturing portion of the associated said base sections, sliding of said movable sections within the associated base sections permitting the varying in width of said first, second, and third elongated members, said capturing portion of each of said base sections comprising a longitudinally disposed groove in a longitudinal edge thereof, each of said movable portions comprising a pair of parallel longitudinal tongues of different widths joined by a longitudinal bight portion, either of said tongues being capturable within said groove, capturing of the wider of said tongues providing a facing portion of a width wider than the facing portion provided when the narrower of said tongues is captured by said groove, said second member for mounting on the top of said door opening when said third member is mounted on said other side of said door opening, said first end of said second member for mating with said first end of said first member, said first end of said third member for selectively mating with a portion of said second member anywhere intermediate said first and second ends thereof, said third member for mounting on the top of said door opening when said second member is mounted on said other side of said door opening, said second end of said third member for mating with said second end of said first member, said first end of said second member for selectively mating with a portion of said third member anywhere intermediate said first and second ends thereof.

2. A door jamb assembly in accordance with claim 1, wherein each of said door stop portions are intergrally formed with the associated said base section.

3. A door jamb assembly in accordance with claim 1, wherein the portion of said second member between said second end thereof and said first end of said third member when mated thereto is severed from the balance of said second member when said second member is mounted at said top of said door opening, the portion of said third member between said first end thereof and said second end of said second member when mated thereto is severed from the balance of said third member when said third member is mounted at said top of said door opening.

4. A door jamb assembly in accordance with claim 3, wherein said second and third elongated members are marked to facilitate cutting into various lengths.

5. A door jamb assembly in accordance with claim 1, wherein said door stop portions of said first, second, and third elongated members are formed integrally with said respective facing portions thereof.

6. A door jamb assembly in accordance with claim 1, wherein said capturing portion of each of said base sections comprises a longitudinally disposed groove, the captured portion of each of said movable sections comprising a longitudinal tongue, said base sections and associated movable sections having at least one surface being coextensive and telescoping when mutually engaged and forming said facing portions.

7. A door jamb assembly in accordance with claim 6, wherein each of said door stop portions are integrally formed with the associated base section.

8. A door jamb assembly in accordance with claim 1, wherein mating of said first end of said third member and said portion of said second member intermediate said first and second ends thereof is provided by notching of said first end of said third member to accommodate therein said door stop portion of said second member associated therewith, the balance of the first end of said third member butting against said facing surface of said second member when mated thereto, mating of said second end of said second member and said portion of said third member intermediate said first and second ends thereof being provided by notching of said second member to accommodate therein said door stop portion of said third member associated therewith, the balance of said second end of said second member butting against said facing surface of said third member.

9. A door jamb assembly in accordance with claim 1, wherein mating of said first end of said first member with said first end of said second member is provided by said door stop portions of said first and second members being shorter in length than said facing portions thereof and terminating a distance in, respectively, from said first end of said second member and said first end of said first member, said first end of said first member and said first end of said second member mating wherein said first end of said second member butts against said facing portion of said second member adjacent to said first end thereof, the end of said door stop portion of said second member adjacent to said first end thereof butting against the outer surface of said door stop portion of said first member, the end of said door stop portion of said first member adjacent to said first end thereof butting against said facing portion of said second member adjacent to said first end thereof, mating of said second end of said first member with said second end of said third member being provided by said door stop portions of said first and third members being shorter in length than said facing portions thereof and terminating a distance in, respectively, from said second end of said third member and said second end of said first member, said second end of said first member and said second end of said third member mating wherein said second end of said third member butts against said facing portion of said third member adjacent to said second end thereof, the end of said door stop portion of said third member adjacent to said second end thereof butting against the outer surface of said door stop portion of said first member, the end of said door stop portion of said first member adjacent to said second end thereof butting against said facing portion of said third member adjacent to said second end thereof.

10. A door jamb assembly in accordance with claim 1, wherein a door is hinged to said first elongated member, said first elongated member being invertible to change the swing of said door.

11. A door jamb assembly in accordance with claim 1, wherein said second and third elongated members are mortised for a lock set strike.

12. A door jamb assembly in accordance with claim 1, wherein said second and third elongated members are marked to facilitate the cutting thereof into various standard lengths.

13. Variable width jamb stock comprising in combination:

elongated base section providing a capturing portion, said capturing portion of said base section including a longitudinal groove disposed therein, said base section and movable section having at least one surface being coextensive and telescoping when mutually engaged and forming said facing portion, said elongated base section further including a door stop portion; and an elongated movable section providing a pair of parallel longitudinal tongues of different widths joined by a longitudinal bight portion, either of said tongues being capturable within said capturing portion of said base section, capturing of the wider of said tongues providing a facing portion of a width wider than the facing portion provided when the narrower of said tongues is captured by said capturing portion.

14. Variable width jamb stock in accordance with claim 13, wherein said door stop portion is integrally formed with said base section.

* * * * *